United States Patent [19]

Alles

[11] 4,439,966

[45] Apr. 3, 1984

[54] BUILDING MODULE HAVING INTERNAL TUBES FOR CARRYING ELECTRICAL WIRES

[76] Inventor: Alfred H. Alles, 260 Bridgeport Dr., El Granada, Calif. 94018

[21] Appl. No.: 258,147

[22] Filed: Apr. 27, 1981

Related U.S. Application Data

[63] Continuation of Ser. No. 819,015, Jul. 25, 1977, abandoned, which is a continuation of Ser. No. 631,762, Oct. 13, 1975, abandoned.

[51] Int. Cl.[3] ..... E04B 5/48

[52] U.S. Cl. ..... 52/221; 52/309.11

[58] Field of Search ..... 52/220, 221, 309.11

[56] References Cited

U.S. PATENT DOCUMENTS

| | | | |
|---|---|---|---|
| 3,228,822 | 1/1966 | Norman | 52/220 X |
| 3,665,662 | 5/1972 | Timbrook et al. | 52/90 X |
| 3,697,633 | 10/1972 | Edgar | 52/221 X |

*Primary Examiner*—Carl D. Friedman

*Attorney, Agent, or Firm*—Townsend & Townsend

[57] ABSTRACT

An improved building module suitable for use either in a wall or floor wherein, the module includes a pair of generally parallel side panels interconnected by first and second pairs of end walls to present a space between the side panels. A first tube spans the distance between and is connected to the first pair of end walls and one or more second tubes span the distance between and are connected to the other pair of end walls. The tubes have open ends and the first tube is offset relative to the second tubes. The tubes and side panels can be cut with a hole saw or the like. After the building module has been put in place, electrical wires can be directed through the tubes and to junction boxes placed in holes cut into one or both panels at locations along the length of each tube or at the junctions of two tubes. Tongue and groove means can be provided on the outer peripheral margin of the building module to allow it to mate with and to become coupled to another such building module.

1 Claim, 6 Drawing Figures

BUILDING MODULE HAVING INTERNAL TUBES FOR CARRYING ELECTRICAL WIRES

This is a continuation of application Ser. No. 819,015 filed July 25, 1977, now abandoned, which was a continuation of application Ser. No. 631,762, filed Oct. 13, 1975, now abandoned.

This invention relates to improvements in building units of the type suitable for making walls or floors and, more particularly, to a building module having internal tubes for carrying electrical wiring.

BACKGROUND OF THE INVENTION

In erecting floors and walls, modular building units have found favor inasmuch as they can be assembled at a factory and readily installed to minimize labor costs. For the most part, these building units must be open at one side so that electrical wiring and junction boxes can be put into place, following which the open side is closed by a side panel, such as a wallboard panel.

There is no existing conventional modular building units which have wiring fixtures, switches, wall plugs and the like already assembled when they reach a building site. All such units require additional assembly of such parts after the units have been installed. A need, therefore, has arisen for a factory-made modular building unit having internal wire-carrying means to permit electrical wires to be quickly moved into and through the unit or to locations at which junctions boxes can be selectively placed without having to partially disassemble the unit, such as by removing a side panel, and without having to blindly drop wires from a space above or below an existing wall unit.

Disclosures relating to this field but not illustrating the last-mentioned concept are U.S. Pat. Nos. 2,076,650; 2,896,278; 3,621,624 and 3,697,633.

SUMMARY OF THE INVENTION

The present invention is directed to an improved modular building unit capable of satisfying the above need and, to this end, is directed to a building module which can be used to form a floor or wall with other such modules. The module has internal tubes which guide electrical wiring into and through the module itself or to specific locations internally thereof. The module has a pair of spaced, generally parallel side panels interconnected by first and second pairs of end walls. A first open end tube extends between and is coupled to the first pair of end walls and one or more open end second tubes span the distance between and are connected at the ends thereof to the second pair of end walls. The end walls have holes therein for receiving respective ends of the corresponding tubes and the side panels and the tubes are formed of materials capable of being cut, such as by a hole saw. Thus, junction boxes can be readily mounted in either or both side panels at various locations and electrical wiring can be readily directed to the junction boxes by way of the tubes long after the module has been put in place so long as the workman knows the general location of the tubes within the module. Typically, the tubes are at specific locations relative to the side and end margins of the module and such dimensions can be standardized for a whole building or a group of buildings utilizing the module as a building unit.

The present invention permits wires to be threaded into and through the module even after years of use.

Thus, if it is desired to rewire a building containing a number of the modules, it is a simple matter to withdraw old wiring and thread new wiring into and through the tubes in accordance with the new wiring design. The present invention, therefore, provides a unit which is extremely versatile in use and can be attractive in appearance inasmuch as it can have many different types of external textures, colors, designs, yet is provided with a permanent internal wire-carrying structure of the type described.

The primary object of this invention is to provide an improved building module having permanently installed internal tubular structure to provide a built-in wire-carrying capability which is part of the ready-to-install module itself and permits efficient, easy wiring of a wall or floor of which the module forms a part.

Another object of this invention is to provide a building module of the type described wherein the module presents a building unit having a number of tubes which are generally perpendicular to each other to assist in wiring of the module and the building unit, such as a floor or a wall, after the floor or wall has been erected, all of which is accomplished without disassembling the module or any part thereof.

Other objects of this invention will become apparent as the following specification progresses, reference being had to the accompanying drawing for an illustration of the invention.

Figure 1:
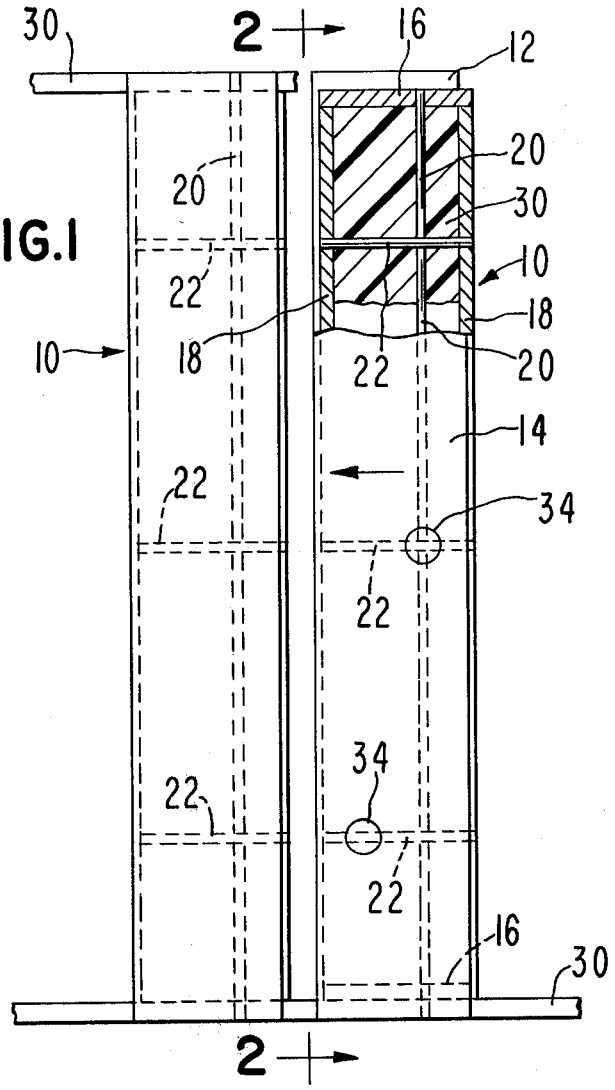
FIG. 1 is a side elevational view of a pair of modules of the type forming the present invention.

The building module of this invention is broadly denoted by the numeral 10. It has a pair of spaced, generally parallel, rectangular side panels 12 and 14 which are interconnected by a first pair of generally parallel end walls 16 and a second pair of generally parallel end walls 18, the end walls being adjacent to the outer margins of the side panels. End walls 18 are generally perpendicular to end walls 16 as shown in FIG. 1. Side panels 12 and 14 are of any other suitable material capable of being cut, such as by a hole saw or the like. For instance, the side panels can be of plywood, particle board and gypsum wallboard. End walls 16 and 18 are shown as being imperforate but they can be of other construction as well. Typically, they are 2×4 members and are secured to the side panels by nails. Each end wall has one or more holes therethrough for mounting wire-carrying tubes hereinafter described.

The module is provided with two or more wire-carrying tubes in the space between the sidewalls and end walls for carrying electrical wiring. A first tube 20 spans the distance between end walls 16. Each end wall 16 has a hole therethrough for receiving the corresponding end of tube 20, and the ends of tube 20 frictionally engage respective end walls and are thereby effectively coupled thereto. The end faces of tube 20 are shown in FIG. 1 as being essentially flush with the outer surfaces of respective end walls 16.

Figure 2:
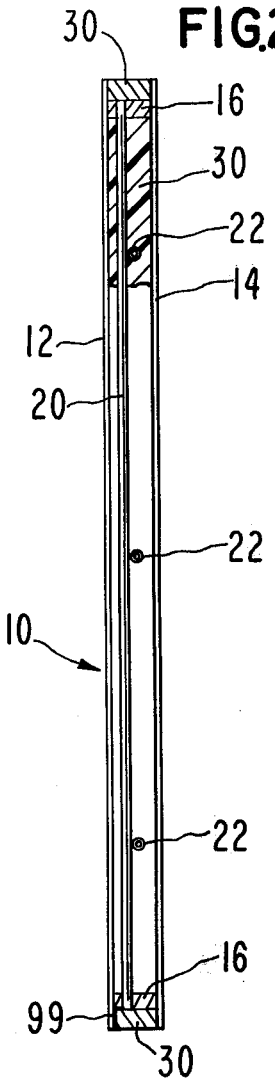
FIG. 2 is a side elevational view looking in the directions of line 2—2 of FIG. 1.
Figure 3:
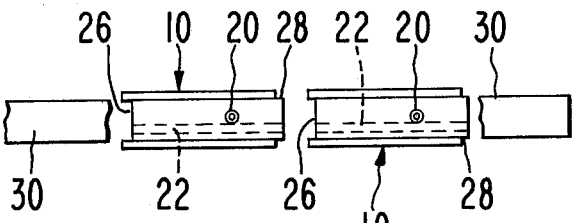
FIG. 3 is a top plan view of the assembly of FIG. 1.

A number of second tubes 22 are provided at spaced locations along the length of tube 20 and are perpendicular thereto and in a plane parallel to the plane of tube 20 as shown in FIG. 2. Each tube 22 spans the distance between end walls 18 and extends into respective holes through the end walls and is in frictional engagement therewith, whereby the tube is effectively coupled to the end walls 18. While three such tubes 22 are shown, any number can be provided, even only a single tube 22, if desired.

The tubes are formed of a material capable of being cut, such as by using a hole saw which cuts one of the side panels of module 10. For instance, the tubes can be of a cardboard or other paper based material or can be of plastic. The purpose of making the tubes of a material capable of being cut is to allow a workman to drill a hole into module 10 through a side panel thereof and simultaneously with the drilling of the hole in the side panel, one or two of the tubes adjacent to the hole in the side panel can also be cut in the same sawing operation. As shown in FIG. 1, the end faces of tubes 22 are substantially flush with the outer surfaces of corresponding end walls 18.

The assembly of the parts of module 10 can be done at a factory and the module can be shipped fully assembled to a job site. No other structure needs to be added to the module and it is ready to be erected with other modules to form a floor or a wall.

A number of modules 10 are adapted to be connected together to form a wall or a floor as shown in FIG. 1 which shows two adjacent modules 10 in position to be moved together to form a wall, for instance. For purposes of illustration, both modules are constructed with outer peripheral connecting means for interconnecting the modules. Such means includes tongue and groove structure at the extremities of each module adjacent to its end walls 18. For instance, a recess 26 is formed at one end margin of each module 10 and a projection 28 is formed at the other end margin. The recess and projection are formed by slightly offsetting side panels 12 and 14 (FIG. 1) relative to the rectangular frame defined by end walls 16 and 18 so that one side margin of each panel extends beyond one end wall 18 to form the recess but the other end margin of the side panel does not extend quite to the end face of the other end wall 18, whereby a portion of the latter projects laterally of the sidewall.

The lengths of side panels 12 and 14 are shown as being longer than the lengths of end walls 18 so as to form upper and lower channels for receiving transverse connecting members 30, such as a 2×4 or the like, as shown in FIGS. 1 and 2. These tongue and groove and channel features are not essential to carrying out the invention but have been shown to illustrate one way of facilitating the connection of a pair of adjacent modules together to form a floor or wall. Other ways of connecting them can be used and such ways are within the skill of the ordinary artisan.

The interior space of module 10 is filled with a filler material 30 for providing insulation for the module. Any one of a number of conventional materials can be used for this purpose. Also, the filler material has a dual function of holding tubes 20 and 22 in place even after they have been cut intermediate their ends to expose the wiring carried thereby. To this end, the filler material preferably bonds to the interior surface of the module and to the outer surfaces of the tubes, yet the filler material can be easily cut.

Figure 4:
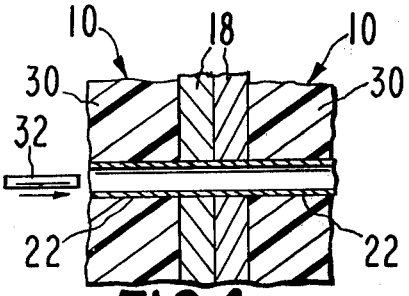
FIG. 4 is an enlarged, fragmentary, cross-sectional view of two adjacent, abutting modules.

A typical wall or floor assembly uses a number of modules 10 in side-by-side relationship. For the illustrated modules 10 of FIG. 1, this means that upper and lower members 30 are provided in corresponding upper and lower channels and these members interconnect adjacent pairs of modules 10 as shown at the bottom of FIG. 1. The modules are then pushed together so that end wall 18 of one module 10 is in juxtaposition with end wall 18 of the other adjacent module 10 as shown in FIG. 4. When this occurs, corresponding tubes 22 of the adjacent modules are in alignment and communication with each other so that wiring 32 can be directed completely through both aligned adjacent tubes 22. Once the modules are in place, wiring can then be fed through one or more tubes of one or more of the modules forming the wall.

While any number of different electrical fixtures can be coupled to module 10 once the latter is put into place as a wall or a floor, one typical accessory is a junction box which can be placed at any location along the length of one of the tubes or at a location adjacent to the junction of two tubes. Both of these situations are illustrated in FIG. 1. For detail, reference is had to FIG. 6, wherein a junction box 34 is disposed within a hole 36 cut in side panel 14, such as by the use of a hole saw or the like. The cutting of hole 36 can progress so that it also cuts into the filler material 30 and through tube 22 aligned with hole 36. The cut can continue through tube 20 if such tube is in the path of the cut. Thus, wiring can be directed through tube 22 until it reaches the opening therein and the wiring denoted by the numeral 32 can then be directed through the rear of junction box 34 and into the interior thereof. A typical face plate can be put on the front open end of the junction box once the wiring installation has been completed. The junction box can contain a switch, female plug or other electrical part as desired or needed.

Figure 5:
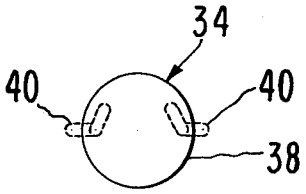
FIG. 5 is a rear elevational view of a junction box useable with the module of this invention.
Figure 6:
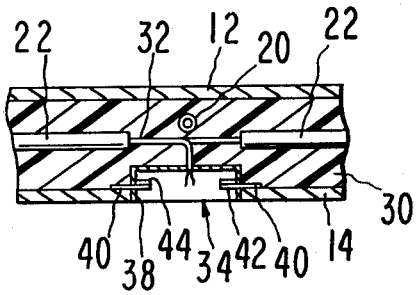
FIG. 6 is an enlarged, fragmentary, cross-sectional view of the module showing the way in which the junction box is mounted thereon.

For purposes of illustration, a simple junction box is one which is circular as shown in FIG. 5 and has a cylindrical sidewall 38 provided with a pair of spaced slots for receiving pivotal tabs 40 coupled in any suitable manner, such as by pins 42 to ears 44 rigid to and projecting inwardly from the inner surface of sidewall 38. To install the junction box, tabs 40 are in the retracted, dashed line position of FIG. 5 when the junction box is put into place. Once the junction box is installed as shown in FIG. 6, tabs 40 are then pivoted outwardly and through the slots so that they engage the inner surface of side panel 14 and thereby maintain the junction box in place. Other junction box constructions can be used if desired.

Plastic or sheet metal flashing can be used at various locations as desired or needed. For instance, flashing 99 is shown in FIG. 2 near member 30. Also, tubes 20 and 22 can be on noninflammable material to prevent fire damage to wiring carried thereby. The tubes can carry TV cables and other such signal conveying means and is not limited to electrical wiring.

I claim:

1. A building unit comprising: a pair of spaced, nonmetallic side panels; a first pair of spaced end walls and a second pair of spaced end walls, the first and second pairs of end walls interconnecting and spanning the distance between the side panels at the outer peripheral margins thereof so that the side panels and the end walls present a hollow space between the side panels and form a building unit capable of being used with other such units to present a building construction, each end wall having a tube-receiving hole therethrough; a pair of generally perpendicular, paperbased tubes in the space between the side panels, one tube spanning the distance between and frictionally received at the ends thereof in respective holes of the first pair of end walls, the other tube spanning the distance between and frictionally received at the ends thereof in respective holes of the second pair of end walls, the tubes being in generally parallel planes adjacent to each other at a location between the side panels, the ends of the tubes being open and substantially flush with outer surfaces of respective end walls to allow wiring to be directed into either end of each tube; and a mass of insulation material in said space and bonded to the inner surfaces of said side panels and end walls and to the outer surfaces of the tube, the tubes, the side panels and said insulation material mass being of materials capable of being cut when the tubes are in said space to permit access to the tubes intermediate their ends, whereby electrical fixtures can be mounted on said one side panel and electrically coupled to wires running through the tubes.

* * * * *